US008056518B1

(12) United States Patent
Novak et al.

(10) Patent No.: US 8,056,518 B1
(45) Date of Patent: Nov. 15, 2011

(54) VALVE LASH ADJUSTMENT NUT

(75) Inventors: Aaron J. Novak, Oshkosh, WI (US); Christopher R. Jenks, Rosendale, WI (US)

(73) Assignee: Brunswick Corporation, Lake Forest, IL (US)

( * ) Notice: Subject to any disclaimer, the term of this patent is extended or adjusted under 35 U.S.C. 154(b) by 413 days.

(21) Appl. No.: 12/420,141

(22) Filed: Apr. 8, 2009

(51) Int. Cl.
*F01L 1/34* (2006.01)

(52) U.S. Cl. ..... 123/90.16; 123/90.39

(58) Field of Classification Search ..... 123/90.16, 123/90.39, 90.41, 90.42, 90.43; 74/559
See application file for complete search history.

(56) References Cited

U.S. PATENT DOCUMENTS 3,096,750 A 7/1963 Bouvy et al.
3,532,080 A 10/1970 Saruta et al.
3,791,355 A 2/1974 Bergmann et al.
3,797,336 A * 3/1974 Howe ..... 81/125
4,519,345 A 5/1985 Walter
4,638,772 A 1/1987 Burandt
4,856,467 A * 8/1989 Kronich ..... 123/90.43
5,645,025 A 7/1997 Caya et al.
7,363,893 B2 4/2008 Rohe et al.
7,383,799 B1 6/2008 Wynveen et al.

* cited by examiner

*Primary Examiner* — Zelalem Eshete
(74) *Attorney, Agent, or Firm* — Williams D. Lanyi

(57) ABSTRACT

A valve actuating system determines a shape of its jam nut surface as a function of a resultant force on a ball stud exerted by a rocker arm on the ball stud during operation of the valve train. The contact surface of the jam nut, which is pressed against an associated surface of the head of an engine, is a conical surface with an included angle that is generally twice the magnitude of an angle between a resultant force on the ball stud and a central axis of the ball stud and its associated jam nut. Certain accommodations can be made in order to reduce the cost of the system that would occur if perfect mathematical preciseness with a most preferred embodiment of the present invention is employed.

19 Claims, 5 Drawing Sheets

VALVE LASH ADJUSTMENT NUT

BACKGROUND OF THE INVENTION

1. Field of the Invention

The present invention is generally related to an engine valve system and, more particularly, to a valve lash adjustment nut that is configured to reduce the likelihood of wear that would otherwise degrade the positional accuracy of the valve actuation apparatus.

2. Description of the Related Art

Those skilled in the art of internal combustion engines are familiar with many different techniques and devices that can be used to control or adjust valve lash. Some valve trains for internal combustion engines utilize a mechanical lash adjustor which consists of a threaded ball stud and a jam nut to inhibit rotation of the ball stud and the resulting degradation of positional accuracy that can be caused by inadvertent rotation of the ball stud. In some applications, the ball stud and jam nut are made from high strength steel and the portion of the internal combustion engine head with which they interface is typically provided with an insert made of steel or another hard material. Variations of valve trains and lash adjustment mechanisms have been developed and improved over many years.

U.S. Pat. No. 3,096,750 which issued to Bouvy et al. on Jul. 9, 1963, describes an overhead camshaft engine valve mechanism. It has a simplified valve train construction in which rocker shafts are eliminated and simple inexpensive valve train elements are employed between conventional camshaft lobes and each engine valve stem.

U.S. Pat. No. 3,532,080, which issued to Saruta et al. on Oct. 6, 1970, describes a device for driving poppet valves of an engine. A low noise device for driving poppet valves of an overhead cam engine is described. The valves are actuated by rocker arms selectively rotated by cams. A bias spring is provided for each rocker arm so as to keep the rocker arm always in contact with the cam.

U.S. Pat. No. 3,791,355, which issued to Bergmann et al. on Feb. 12, 1974, describes a mechanical lash adjustor for overhead cam engines. The mechanism is intended for use as a direct replacement for a hydraulic lash adjustor in overhead cam engines. It includes a stud threaded into an insert and having means at one end for supporting a rocker arm. The insert is designed to fit directly into an opening provided in a conventional engine head.

U.S. Pat. No. 4,519,345, which issued to Walter on May 28, 1985, describes an adjustable ratio rocker arm. Adjustments to the amount of valve lift in an engine are readily made by corresponding adjustments to the location at which a cam actuated push rod contacts the push rod side of the valve actuating rocker arm. The device provides an accurate and rapid means for adjusting the push rod contact position by slotting the push rod side of the rocker arm and fitting a square adjustment plate against a fixed index on top and bottom surfaces of the push rod side.

U.S. Pat. No. 4,638,772, which issued to Burandt on Jan. 27, 1987, describes a valve actuating apparatus for minimizing the need for lash adjustment. A cam unit and a follower are configured so that the surfaces between which lash is measured are for all intent and purposes removed or segregated from the surfaces used for effecting valve movement. The modified interaction between the cam and the surface the cam bears against compensates for reduction in valve lash.

U.S. Pat. No. 5,645,025, which issued to Caya et al. on Jul. 8, 1997, describes an internal combustion engine which includes a cast cylinder head having as-cast alignment ribs that align a squared-off fulcrum in the rocker assembly. The rocker arm also has two substantially flat surfaces that engage the planar sides of the fulcrum to minimize lateral movement of the rocker arm.

U.S. Pat. No. 7,383,799, which issued to Wynveen et al. on Jun. 10, 2008, discloses a method for monitoring the operating condition of an engine valve system. A system is provided for monitoring changes in the operation of a valve system of an engine. An accelerometer provides vibration related signals that are obtained by a microprocessor or similarly configured device and compared to a reference or baseline magnitude. The obtaining step can comprise the steps of measuring, filtering, rectifying, and integrating individual data points obtained during specific windows of time determined as a function of the rotational position of the crankshaft of the engine. These windows in time are preferably selected as a function of the position of exhaust or intake valves as they move in response to rotation of cams of the valve system.

U.S. Pat. No. 7,363,893, which issued to Rohe et al. on Apr. 29, 2008, describes a system for variable valvetrain actuation. An electromechanical variable valvetrain actuation system for controlling the poppet valves in the cylinder head of an internal combustion engine is described. The system varies valve lift, duration, and phasing in a dependent manner for one or more banks of engine valves. A rocker subassembly for each valve or valve pair is pivotally disposed on a control shaft between the cam shaft and the roller finger follower. The control shaft may be displaced about a pivot axis outside the control shaft to change the angular relationship of the rocker subassembly to the cam shaft, thus changing the valve opening, closing, and lift.

The patents described above are hereby expressly incorporated by reference in the description of the present invention.

In engines with aluminum cylinder heads that do not use a steel insert, there can be insufficient strength in the aluminum threads for proper retention at the jam nut to head interface. As a result, during each valve event, the jam nut to head interface can slip from side to side. As a result, the contact surfaces of the jam nut and head can become worn as a result of abrasion. This wear can loosen the contact between the jam nut and the engine head, resulting in a change in valve lash. If the contact surfaces of the jam nut and engine head are perpendicular to the central axis of rotation of the jam nut, the arrangement is particularly sensitive to wear of either or both of these contacting surfaces as a result of relative movement between them that can result from vibration caused by repetitive valve events. It would therefore be significantly beneficial if the wear of the jam nuts could be decreased or completely inhibited.

SUMMARY OF THE INVENTION

An actuating apparatus made in accordance with a preferred embodiment of the present invention comprises a rocker arm disposed in contact with a valve at a first location, a cam disposed in contact with the rocker arm at a second location, a pivot disposed in contact with the rocker arm at a third location, a stud attached to the pivot and configured to support the pivot relative to a structure, such as the head of an engine, and a jam nut movably attached to the stud and configured to retain the pivot at a preselected distance from the structure. The jam nut can comprise a first surface which is movable into contact with a second surface of the structure. The first surface can be generally conical with an included angle which is selected as a function of the angle between a central axis of the stud and a force exerted by the rocker arm on the stud when the cam is at a preselected rotational angle about its axis of rotation.

In a preferred embodiment of the present invention, the included angle of the cone is generally equal to twice the magnitude of the angle between the central axis of the stud and the force exerted by the rocker arm on the stud at a time when the cam is at a preselected rotational angle about its axis of rotation. The force is a resultant force having a radial component which is generally perpendicular to the central axis of the stud and an axial component which is generally parallel to the central axis. In a particularly preferred embodiment of the present invention, the preselected rotational angle of the cam is selected to result in the radial component being generally equal to approximately half of its maximum magnitude at all of the rotational angles of the cam about its axis of rotation.

In a preferred embodiment of the present invention, the pivot is defined by a convex hemispherical surface disposed at an end of the stud and a concave hemispherical surface formed in the rocker arm. In a preferred embodiment of the present invention the structure is a head of an engine and the stud is attached in threaded engagement within a threaded hole of the structure. The jam nut is attached in threaded engagement with the stud. The first surface is movable into contact with the second surface in response to movement of the jam nut away from the pivot. The third location can comprise a series of contact points between the rocker arm and the pivot which results in relative movement between the rocker arm and the stud as the cam rotates about its axis of rotation. In a particularly preferred embodiment of the present invention, the pivot is formed as an integral part of the stud.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
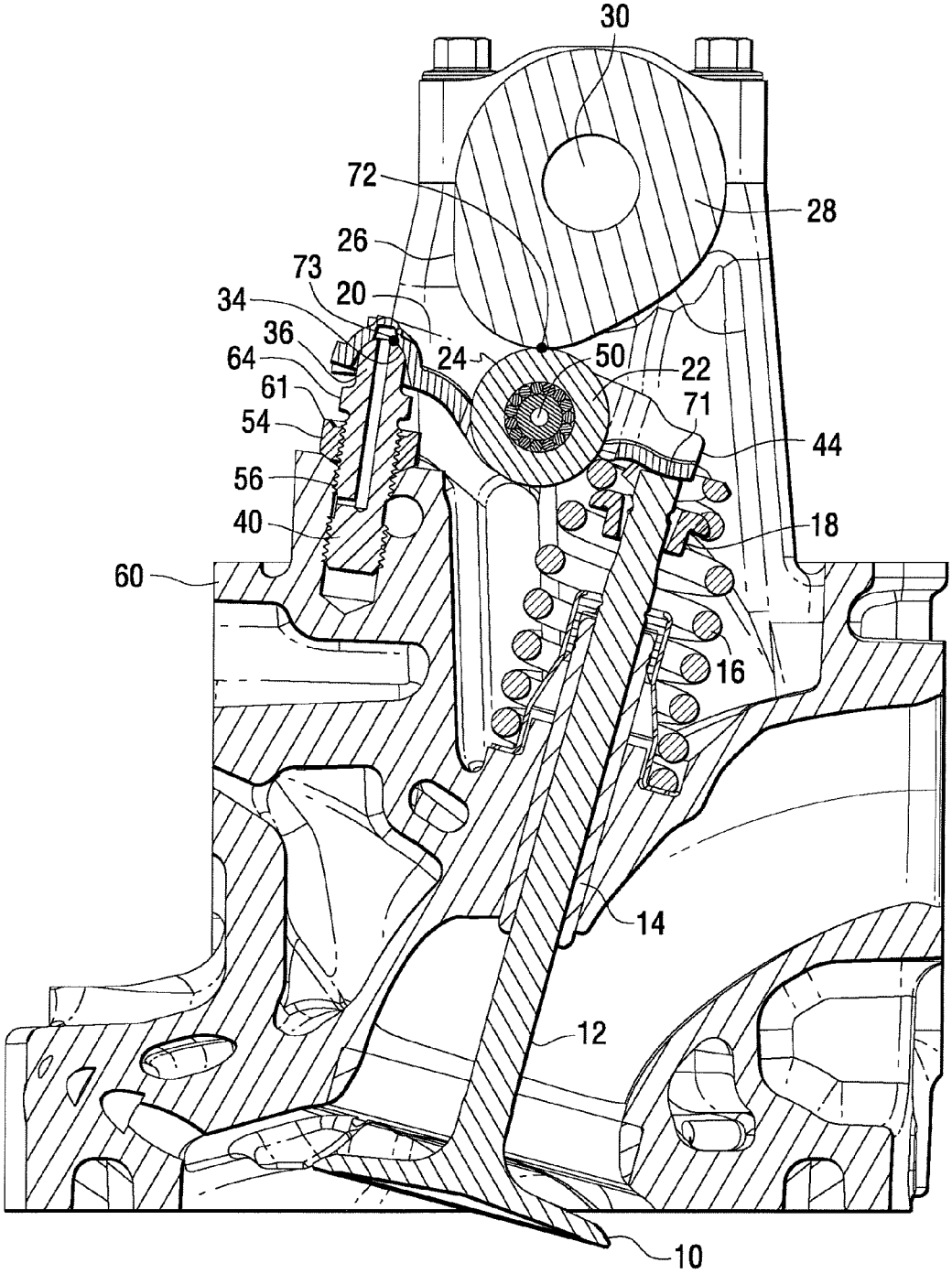
FIGS. 1 and 2 are section views of a valve actuating system associated with two different cam positions.

Throughout the description of the preferred embodiment of the present invention, like components will be identified by like reference numerals.

Figure 2:
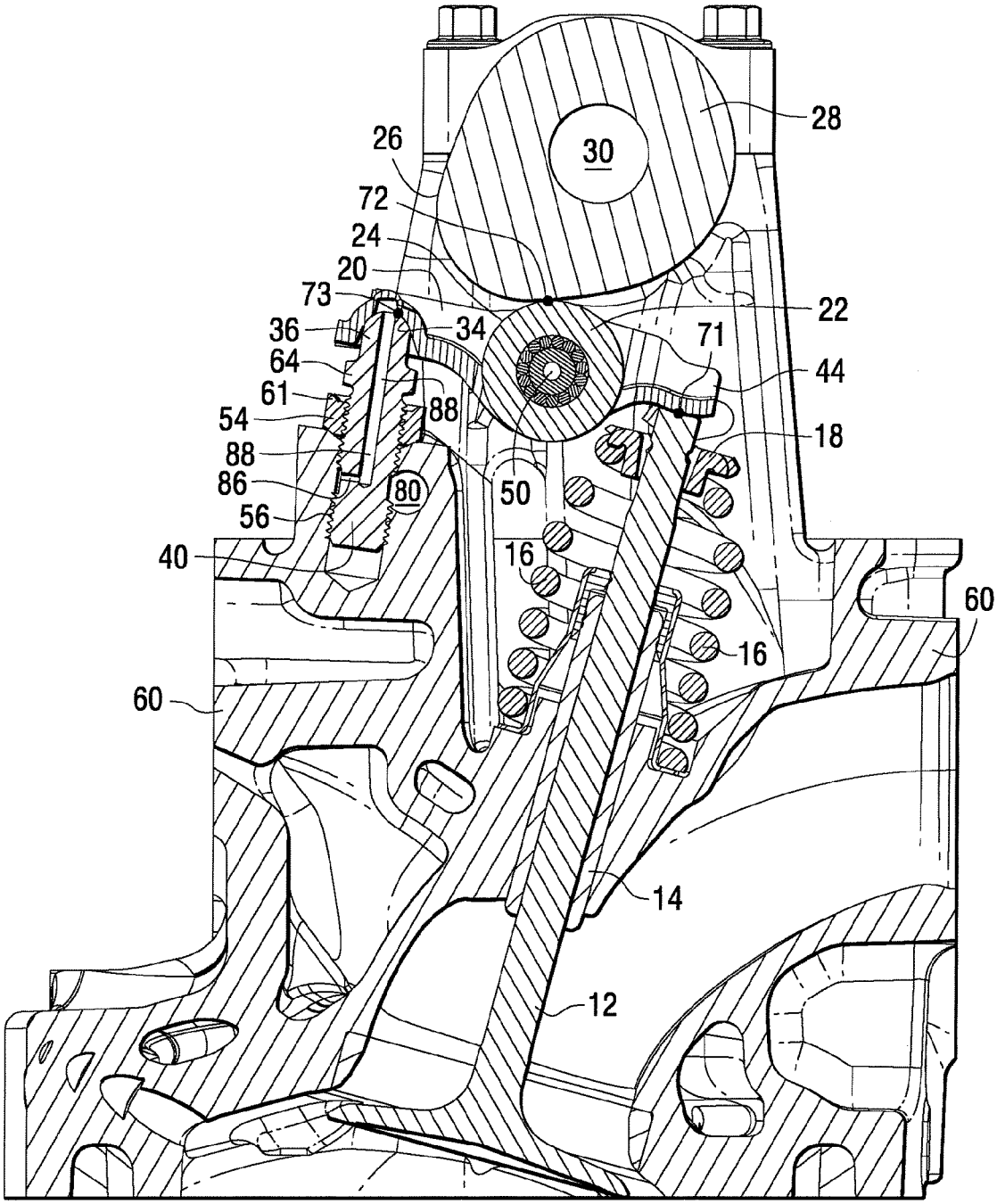

FIGS. 1 and 2 are section views of a valve actuation system incorporating the concepts of the present invention. In a manner generally known to those skilled in the art, a valve 10, with a valve stem 12, is supported with a valve guide 14, a valve spring 16, and a retainer 18. A rocker arm 20 has a cam roller 22 which provides a cam follower surface 24 disposed in contact with a cam surface 26 of a cam 28. The cam 28 is supported by and rotates about a central axis of a cam shaft 30. A cup 34 is formed at an end of the rocker arm 20 and is shaped to receive a ball 36 which is a hemispherical end portion of a ball stud 40. The distal end of the valve stem 12 is disposed in contact with a first end 44 of the rocker arm 20.

With continued reference to FIGS. 1 and 2, the cam roller 22 is rotatably attached to the rocker arm 20 at axis 50. A jam nut 54 is threaded onto threads 56 of the ball stud 40 to allow the ball stud 40 to be locked into position relative to the head 60 of an engine. As will be described in greater detail below, the jam nut 54 is provided with a hex-head portion 61 and the ball stud 40 is provided with a hex-head portion 64 to allow these two components to be forcibly rotated relative to each other in a manner that causes a first surface of the jam nut 54 to be moved downwardly into contact with a second surface of the head 60. This forcible contact, in combination with interaction between the threads of the jam nut 54 and ball stud 40, lock the ball stud 40 into position relative to the head 60 in order to fix the position of a pivot point 73 of the ball stud 40 and rocker arm 20. A first contact point 71, between the rocker aim 20 and the valve stem 12, a second contact point 72, between the cam roller 22 and cam 28, and a third contact point 73, between the rocker arm 20 and the ball stud 40, define the forces on the rocker arm 20 and, in turn, the reactive forces by the rocker arm 20 on the valve stem 12, the cam 28, and the ball stud 40. These forces will be described in greater detail below.

FIG. 1 shows the cam 28 rotated to a 20 degree position from peak lift about its cam shaft 30 and FIG. 2 shows the cam 28 rotated to a 40 degree position about its cam shaft 30. As the cam 28 rotates about its center of rotation, the forces at the first, second, and third contact points, 71-73, change. As a result, the resultant force on the ball stud 40 at the third contact point 73, or pivot, changes in response to the rotation of the cam 28. The relationship between these forces and the cam position will be described in greater detail below, but first it is important to understand the primary purposes of the present invention and how it addresses certain problems that can occur during the operation of the valve system.

As understood by those skilled in the art of internal combustion engines, the proper operation of an engine relies significantly on the accurate reciprocal motion of the valve 10. This reciprocal motion is governed by the magnitude of movement of the rocker arm 20 in response to rotation of the cam 28. The rocker arm 20 relies for its support on the three contact points, 71-73, described above. The magnitude of motion of the first end 44 of the rocker arm 20 in response to rotation of the cam 28 depends on the proper position of the third contact point 73, or pivot, of the rocker arm 20. It is also very important that this third contact point 73 remains at known and predictable positions, as a function of cam rotation, which are fixed relative to the position of the head 60. Throughout the description of the preferred embodiment of the present invention, contact point 73, or the pivot, will be referred to as a single point. However, it should be understood that the nature of the cup 34 and ball 36 arrangement can result in variations in the location of the third contact point 73 because of the sliding relationship that can occur in joints of this type. As these two hemispherical surfaces slide relative to each other, different contact points will become the effective pivot of the rocker arm 20 relative to the ball stud 40. Notwithstanding this sliding relationship between the contacting hemispherical surfaces, the specific location of the third contact point 73, in relation to the head 60 of the engine, is expected to be repeatable and predictable for any given rotational position of the cam 28. Therefore, when the third contact point 73 is described as being fixed, known, and predictable, it should be understood that this is in reference to particular rotational positions of the cam and, as understood by those skilled in the art of internal combustions engines, the actual third contact point 73 between the hemispherical surfaces is expected to change as the rocker arm moves in response to rotation of the cam. However, the third contact point 73 is not expected to move relative to the head for any specific cam position from one valve event to the next. Any movement of the pivot, or third contact point 73, relative to the head 60 will have serious deleterious effect on the operation of the engine. Not only will the effective operation of the engine be changed, but the valve train itself may disassemble with disastrous effect. To maintain the third contact point 73, or pivot, in its expected position relative to the engine, the jam nut 54 must hold the ball stud 40 firmly in its preset position. However, certain circumstances might result in wear that can, in turn, result in a change in the position of the pivot, or third contact point 73.

If relatively hard materials, such as iron or steel, are used for the components shown in FIG. 1, it is not significantly difficult to lock the position of the ball stud 40 through the use of the jam nut 54. However, the use of these relatively hard materials has certain disadvantages. They are more expensive than other materials, such as aluminum. In addition, they are heavier than aluminum and, in certain applications, it is significantly advantageous to use light materials. In outboard motors, for example, the use of lighter and less expensive materials is highly desirable. In some applications, relatively complicated and expensive mechanisms, such as hydraulic lash adjustors, can be used to maintain the accurate position of the pivot, or third contact point 73, relative to the head 60 of the engine. However, if the reduction in complexity and cost is important, more complicated lash adjustors are not desirable.

When softer and lighter materials, such as aluminum, are used without harder materials as inserts and without hydraulic adjustors, problems can occur if wear changes the position of the ball stud 40 and, as a result, the pivot at contact point 73. As will be described below, changes in forces on the ball stud 40 occur during each valve event and these rapidly changing forces result in vibration which can abrade the soft aluminum at certain locations. As an example, if a traditional jam nut 54 is used, with flat opposing parallel faces, the frequently changing forces on the ball stud 40 and jam nut 54 can cause abrasion between the contact surfaces of those two components and wear will change the effective dimensions. This, in turn, will affect the position of the pivot at the third contact point 73 and the resulting position of the first contact point 71. As discussed above, these changes will not only disadvantageously affect the reciprocal motion of the valve 10, but can also eventually allow the disengagement of the rocker arm 20 from the cam 28, ball stud 40, and valve stem 12. This can lead to the actual disintegration of the valve train structure. In applications where softer materials, such as aluminum, are used and complicated and expensive hydraulic lash adjustors are not employed, it is therefore beneficial if some way is provided to decrease or eliminate the likelihood of wear between the jam nut 54 and the head 60 so that this wear and abrasion does not change the physical position of the pivot at the third contact point 73. That is an important purpose of the preferred embodiment of the present invention.

With continued reference to FIGS. 1 and 2, it should be understood that these two illustrations represent only two instantaneous positions of the cam 28 and the components associated with the rocker arm 20, the valve 10, and the ball stud 40 with its jam nut 54. The positions of the components and the associated forces at the first, second and third contact points, 71-73, continuously change as the cam 28 rotates about the axis defined by its cam shaft 30.

Figure 3:
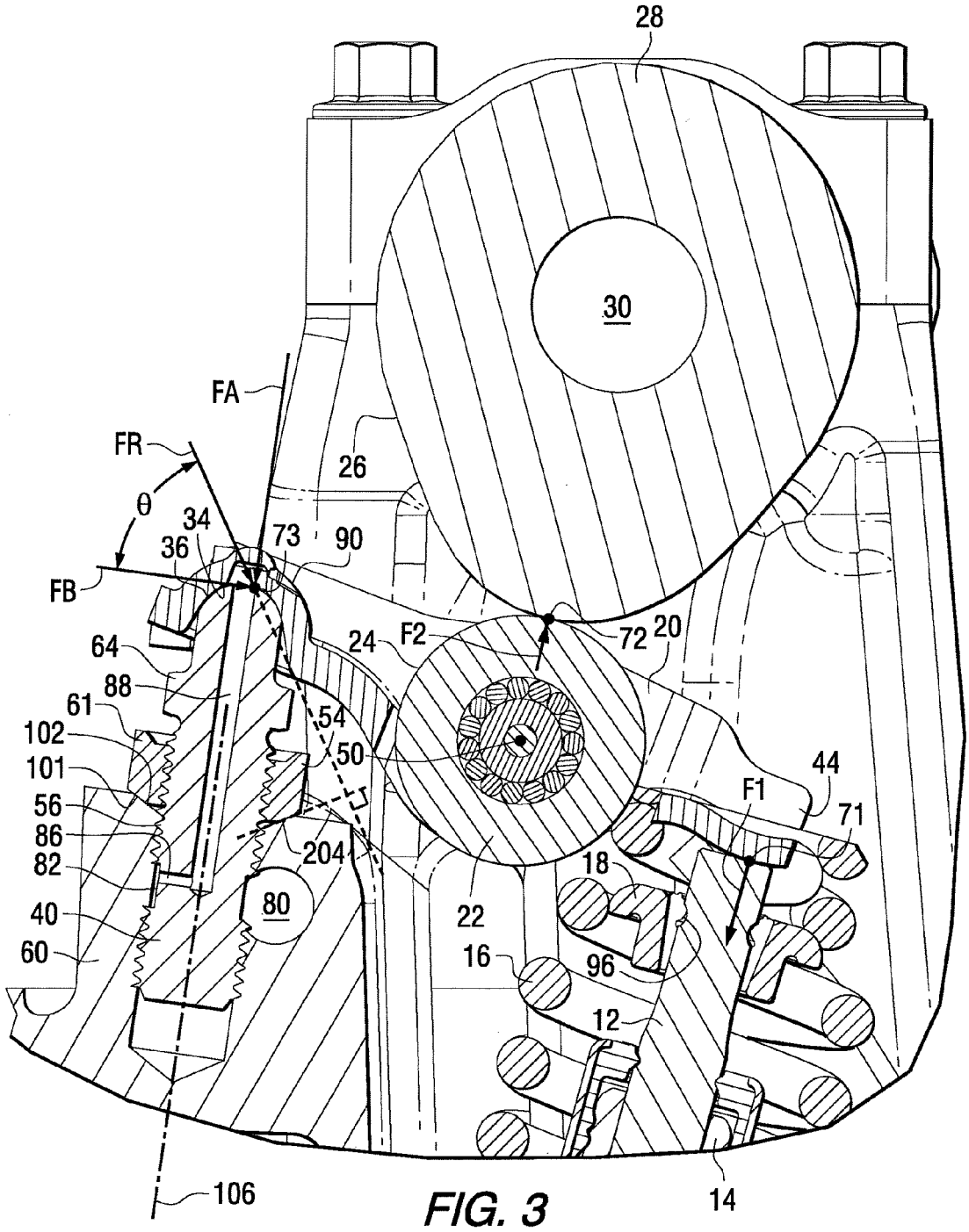
FIG. 3 is an enlarged partial view of a valve actuator.

FIG. 3 is an enlarged view of a portion of FIG. 1 provided to allow some of the individual components to be described with more detail than in FIGS. 1 and 2. In FIG. 3, it can be seen that the ball stud 40 and related components are provided with lubrication through a first conduit hole 80 that conducts oil to a region 82 of the ball stud 40 where some of the threads 56 have been removed. This region 82 allows oil to flow from the conduit 80 to a radial passage 86 and into an axial passage 88 that is formed through a portion of the center of the ball stud 40. This directs the lubricant through the region of the third contact point 73 provided by the hemispherical end 36 of the ball stud 40 which is disposed within the hemispherical pocket 34 at the end of the rocker arm 20. Another opening 90 is formed in the rocker arm 20 to allow some oil to spray in the direction of the cam roller 22 and its cam follower surface 24.

With continued reference to the enlarged illustration of FIG. 3, it can also be seen that a key 96 is provided to attach the retainer 18 to the valve stem 12. Also, the enlarged view of FIG. 3 more clearly shows the first surface 101 of the jam nut 54 and the second surface 102 of the head 60 of the engine. The first and second surfaces, 101 and 102, are forcibly moved into contact with each other when the jam nut 54 is threaded downwardly relative to the ball stud 40. This forcible contact, in combination with the interaction of the thread of both the jam nut 54 and ball stud 40, lock the position of the ball stud 40 relative to the head 60 in order to fix the position of the pivot at the third contact point 73 relative to the head 60. It can be seen that the first surface 101 is formed at an angle relative to the central axis 106 of both the ball stud 40 and jam nut 54. This angle, which forms a conical contact surface, is determined as a mathematical function of the forces exerted by and against the rocker arm 20. More specifically, the included angle of the conical first surface 101 is determined as a function of the resultant force FR exerted on the ball stud 40 and illustrated in FIG. 3.

With continued reference to FIG. 3, a first force F1 is exerted by the rocker arm 20 on the valve stem 12 at the first contact point 71. A second force F2 is exerted on the cam 28 by the cam roller 22 which is attached to the rocker arm 20. The forces at the pivot, or third contact point 73, are represented as an axial force FA which is parallel to the central axis 106 of the ball stud 40 and a radial force FB that is perpendicular to the central axis 106 of the ball stud 40. These two forces, FA and FB, at the pivot of the third contact point 73, can be represented as a resultant force FR as shown. A free body diagram, with forces F1, F2, FA and FB, can be used to solve for unknown forces if sufficient measurements are taken with strain gauges to determine forces FA and FB. The resultant force FR can be calculated as a mathematical function of forces FA and FB. The angle θ can be calculated to determine the angle, as shown in FIG. 3, between the resultant force FR and the force FB which is perpendicular to the central axis 106 of the ball stud 40. As will be described in greater detail below, angle θ, between the radial force FB which is perpendicular to axis 106 and the resultant force FR, is used to determine the appropriate included angle of the conical first surface 101 of the jam nut 54. Although certain accommodations are made (as will be discussed below) that result in an included angle of the first surface 101 which is not precisely and mathematically equal to two times the angle θ, a mathematically precise application of the present invention results in a first surface 101 which is generally perpendicular to the resultant force FR if the vector FR shown in FIG. 3 is extended downwardly to intersect an extension of the right side of the first surface 101. This methodology will be described in greater detail below.

With continued reference to FIGS. 1-3, it can be seen that in a preferred embodiment of the present invention a jam nut 54 is provided with a first surface 101 that is a frustum of a cone with an included angle that is determined as a function of the resultant force FR and its relationship to a line which is perpendicular to the central axis 106 of the ball screw 40. This angular relationship, represented by angle θ in FIG. 3, is equivalent to the angle between the radial force FB and the resultant force FR. In the discussion above, it was mentioned that the included angle of the conical first surface 101 is not precisely and mathematically equivalent to twice the magnitude of angle θ. This minor deviation from specific mathematical certitude is justified in some circumstances by a desire to reduce complexity and cost and facilitate the manufacture of the components used in preferred embodiments of the present invention. This slight variation from mathematical exactness will be described in greater detail below.

Figure 4:
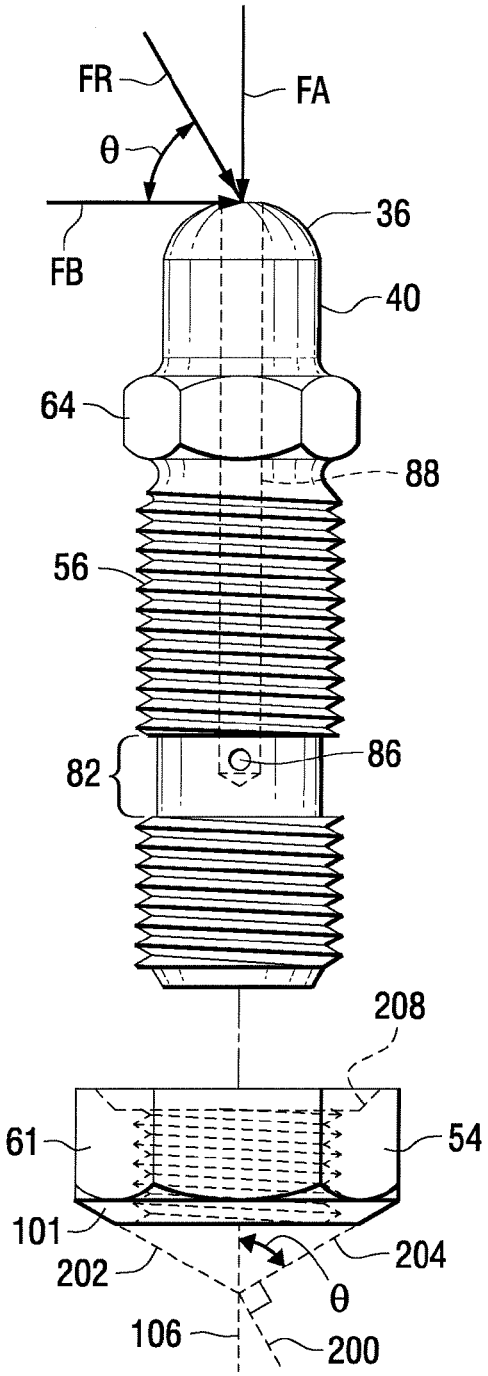
FIG. 4 is an exploded view of a ball stud and jam nut of a preferred embodiment of the present invention.
Figure 5:
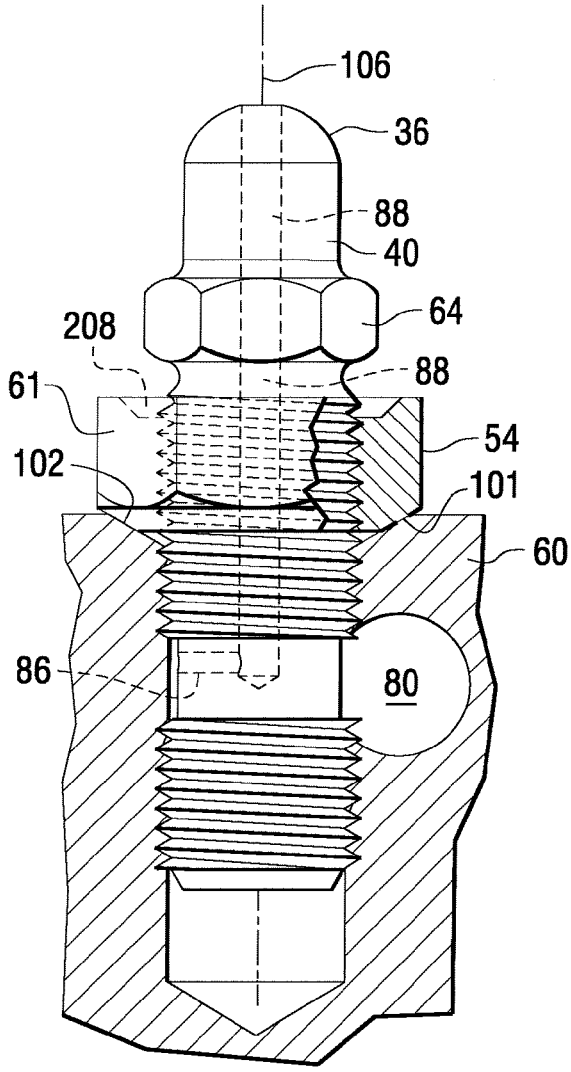
FIG. 5 is an assembled view of the components of FIG. 4 and a portion of the head of an engine.

FIG. 4 is an exploded view of the ball stud 40 and the jam nut 54 with certain geometric construction lines and force vectors illustrated to show how the included angle, which is generally equal to two times angle θ which, in turn, is the angle of the resultant force FR in relation to the central axis 106 of the ball stud 40 and the jam nut 54, is determined. FIG. 5 is an assembled view of the components illustrated in FIG. 4 in addition to a small portion of the head 60 of the engine in order to illustrate the relationship between the first and second surfaces, 101 and 102, when the jam nut 54 is tightened against the second surface 102 of the head 60 by rotating the jam nut relative to the ball stud 40.

With continued reference to FIGS. 4 and 5, it can be seen that a construction line 200 is parallel to the vector of the resultant force FR. Other construction lines, 202 and 204, represent a cone with a surface that is perpendicular to construction line 200. This results in an included angle, between lines 202 and 204, that is generally equal to twice the magnitude of angle θ. These construction lines, 202 and 204, are used to create the frustum of the cone of the first surface 101 which is formed as a bottom surface of the jam nut 54. The second surface 102, shown in FIG. 5, is created to match the first surface 101 and be coplanar with it when the jam nut 54 is forcibly tightened on the ball stud 40 and downwardly against the head 60.

With continued reference to FIGS. 4 and 5, it can be seen that a depression 208 is provided in the upper surface of the jam nut 54 to receive the hex head 64 of the ball stud 40 in the event that this is dimensionally necessary. However, it should be understood that in most cases the tightening of the jam nut 54 relative to the ball stud 40 will tend to move hex head 61 downwardly and away from hex head 64. However, the initial position of hex head 64 in relation to hex head 61 of the jam nut 54 may result in its location within the recess 208 prior to the tightening procedure.

Figure 6:
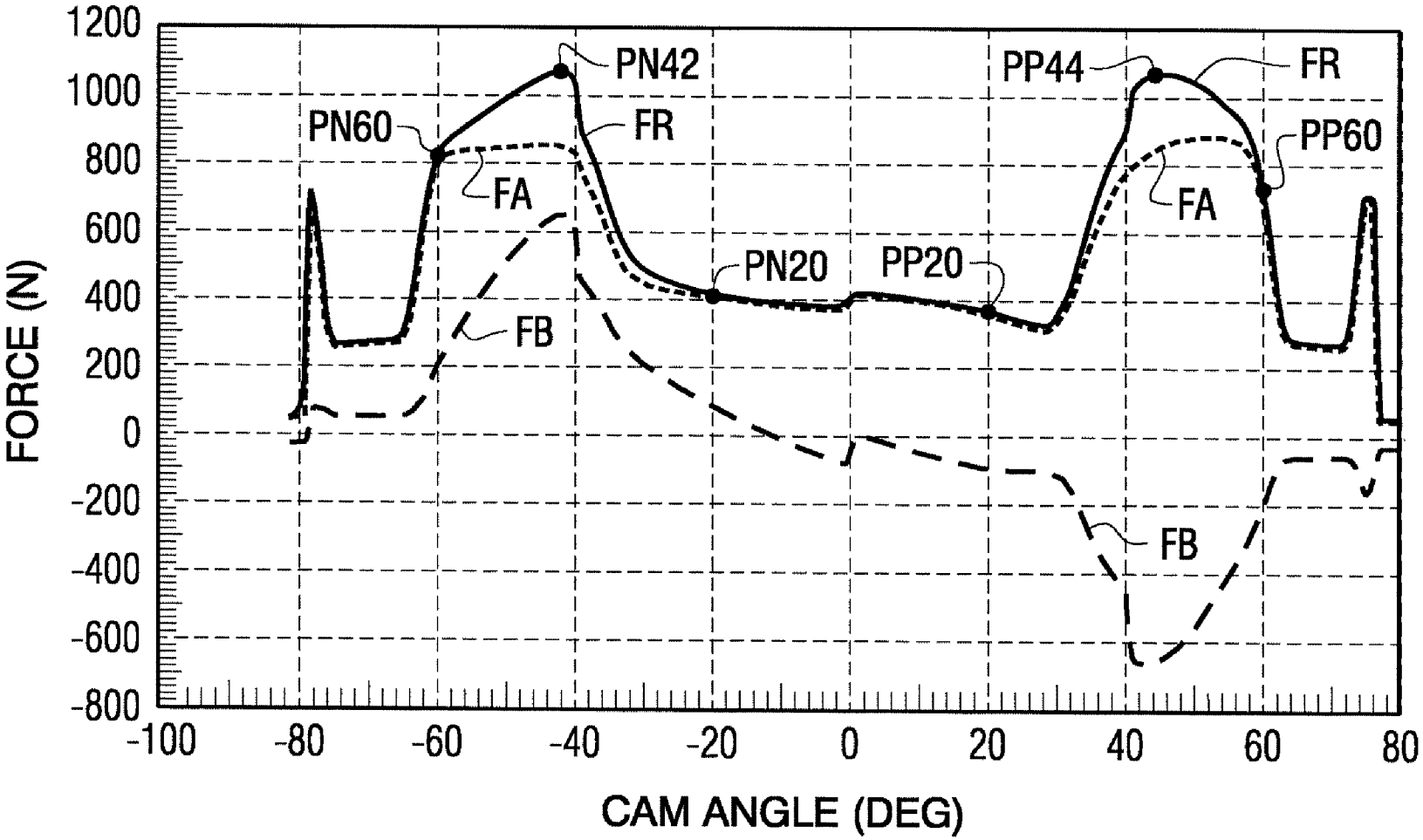
FIG. 6 is a graphical illustration of the magnitudes of certain forces associated with the operation of a valve actuator.

FIG. 6 is a graphical representation of the magnitudes, in Newtons, of the axial force FA, the radial force FB, and resultant force FR exerted on the ball stud 40 by the rocker arm 20 during the rotation of the cam 28 as described above in FIGS. 1-3. Several things can be seen in the graphical representation of FIG. 6. First, the axial force FA remains positive throughout the entire range of rotation of the cam 28. This results from the fact that the camshaft applies a positive or downward force on the ball stud 40 by the rocker arm 20. A negative value for the axial force FA would imply that the cup surface 34 of the rocker arm 20 actually lifted up and away from the hemispherical surface 36 of the ball stud 40. This is highly undesirable and the components of the valve train are assembled with appropriate tolerances that are intended to avoid this condition. It can also be noted that the resultant force FR remains positive throughout the complete rotation of the cam 28 about its axis. The radial force FB, which is perpendicular to the axis 106 of the ball stud 40, experiences both positive and negative forces. As a result, the ball stud 40 experiences cyclic vibrations during each valve event. It is important to understand and realize the implications of the information illustrated in FIG. 6 and also comprehend the manner in which the preferred embodiments of the present invention react to these conditions in order to reduce the effects of the vibration.

With continued reference to FIGS. 1-6, and with particular reference to FIGS. 4 and 6, it can be seen that the magnitude of the resultant force FR changes from a minimum magnitude that is near zero to a maximum magnitude that is greater than 1000 Newtons. That resultant force, which is cyclic in nature as illustrated in FIG. 6, is exerted along an axis at an angle θ that can be calculated for each rotational position of the cam as described above. The positions of the components shown in FIG. 1 represent a cam position of 20 degrees and the positions of the components illustrated in FIG. 2 represent a cam position of 40 degrees. It should be clearly understood that these two positions are chosen to represent these two exemplary positions, of the many that could alternatively be chosen, and are intended to show these relationships and their affect on the forces, FA, FB and FR. Since only a single shape of the first surface 101 must be selected, but the forces are continuously changing as the cam 28 rotates, some accommodations must be made in order to select an appropriate shape for the surface that maximizes the benefits of the present invention. However, it should also be understood that no single included angle for the conical first surface 101 can be the optimum for all cam positions. Therefore, an included angle must be selected that is acceptable for all rotational positions of the cam but not the best choice for each and every angular position of the cam as it rotates through its complete cycle during operation of the engine. In order to further explain these accommodations that are made in preferred embodiments of the present invention, several points are identified in FIG. 6. A point at −20 degrees is identified as PN20. A point at approximately −42 degrees is identified as PN42. Similarly, other points at approximately −60, 20, 44, and 60 degrees are identified as PN60, PP20, PP44 and PP60. It should be clearly understood that these points are used only for the purpose of identifying some of the estimations and accommodations made in order to apply the principles of preferred embodiments of the present invention in view of the fact that no perfect solution is possible for all operating conditions as the cam rotates through its complete cycle. As shown in FIG. 6, maximum values occur at point PN42 and PP44. More significantly, the associated radial forces FB that occur at −42 and 44 degrees have absolute values that are the maximums that are experienced by the ball stud 40. However, it must also be realized that the ball stud experiences all of the range of forces shown in FIG. 6 during a complete rotation of the cam 28. Therefore, it may be desirable to select an included angle for the conical surface 101 which is not the absolute best solution for the maximum force experienced but, instead, is acceptable for all degrees of rotation of the cam and significantly preferred to a simple flat surface of the jam nut as is known in the prior art.

With continued reference to FIGS. 1-6, and with particular reference to FIGS. 4 and 6, empirical data is shown for one particular valve train design. FIG. 1 shows that valve train with the cam 28 at its 20 degree position. FIG. 2 shows that same valve train with the cam 28 at its 40 degree position. Using strain gauges, the axial force FA at 20 degrees (as shown in FIG. 1) was approximately 400 Newtons and the radial force FB, which is perpendicular to axis 106, was approximately 100 Newtons. For these values, a resultant force FR of approximately 412 Newtons and an angle θ of approximately 76 degrees can be calculated. This indicates that, for a cam position of 20 degrees as shown in FIG. 1, an optimum included angle for the conical first surface 101 would be approximately 152 degrees. That same valve train, with the cam 28 rotated to a position of 40 degrees, has a measured axial force FA of approximately 900 Newtons and a measured radial force FB, perpendicular to axis 106, of approximately 700 Newtons. With these values, a resultant force FR of approximately 1140 Newtons at an angle θ of approximately 52 degrees can be mathematically calculated for a cam position of 40 degrees. This indicates that, when the cam is at the 40 degree position, the optimum included angle for the conical first surface 101 would be approximately 104 degrees. Therefore, it can be seen that these two cam positions yield calculated optimum included angles of 152 degrees and 104 degrees for the 20 degree and 40 degree cam positions, respectively. Since a single conical surface shape must be selected for the valve train design that is suitable for all cam angles, some accommodation must be made and a suboptimal selection is required. Since FIG. 6 indicates that the range of force magnitudes represented by the 20 degree and 40 degree positions is generally representative of all of the forces experienced by the ball stud 40 during a complete rotation of the cam 28, one potential solution could be to calculate an average of the two included angles, 152 degrees and 104 degrees, that resulted from the 20 degree and 40 degree cam positions, respectively. The result of this calculation is an included angle of approximately 128 degrees. However, since one of the goals of the present invention is to reduce overall cost of the valve train design while avoiding the deleterious abrasion of the aluminum material, it must be noted that machine tools with an end face of 120 degrees are readily available and would avoid the necessity of custom grinding the machine tools to achieve the 128 degrees that was calculated according to the methodology described above. Therefore, the selection of an included angle of 120 degrees results in a suitable accommodation that achieves most of the desirable results of the preferred embodiment of the present invention while also avoiding some unnecessary expense that could result from the slavish attempt to achieve absolute mathematical certitude. In other words, in circumstances that economically permit the precise following of the concepts of a preferred embodiment of the present invention, an included angle of the conical first surface 101 would be selected to satisfy the conditions indicated by FIG. 6 for the forces associated with rotational cam angles of approximately −42 or 42 degrees regardless of the potential expense. In addition, if the calculations associated with a preferred embodiment of the present invention result in an included angle for the conical first surface 101 that is achievable with non-standard components that are affordable, that precisely calculated included angle will provide the best results. However, alternative embodiments of the present invention take into consideration that other factors may affect the desirability of striving for perfection that may be available with certain embodiments of the present invention, but are not fully justified under all circumstances. In those situations, the accommodations dictate that suboptimal solutions might be acceptable. For example, certain included angles may be small enough to concentrate the forces in a way that results in a hoop stress that is above the ultimate strength of the aluminum of the head and cause cracking. Therefore, a suboptimal magnitude for the included angle should be selected instead of the one that results in a perfect adherence to the mathematical processes described above. As described in the example above, the results shown for 20 degrees of cam rotation and 40 degrees of cam rotation can be averaged in an attempt to respond to the various conditions experienced by the ball stud 40 as the cam rotates through its complete cycle. In addition, when these values were averaged, a solution of 128 degrees included angle was recognized as potentially requiring special tooling in order to achieve the best results available with the most preferred embodiment of the present invention. Therefore, a slight accommodation was made in order to use a standard tooling angle of 120 degrees. This minor difference, between the calculated 128 degrees and the standard 120 degrees was determined to be acceptable in view of the fact that the overall goal was to make available the use of inexpensive materials and components. Therefore, the selection of 120 degrees as the included angle in this specific example was made in combination with the selection of aluminum as the material for the head 60 and the use of mechanical valve adjustment technique rather than the more complex and expensive hydraulic lash adjustors.

The basic concepts of preferred embodiments of the present invention relate to the determination of a beneficial surface shape for the contact surface of a jam nut. More specifically, in preferred embodiments of the present invention, this contact surface is selected in a way that reduces the deleterious effect that can be caused by cyclic abrasive motion resulting from forces exerted against the ball stud by the rocker arm of a valve train system. Recognizing that these cyclic forces are a natural result from the normal action of the valve train, preferred embodiments of the present invention calculate a shape of the contact surface which reduces the effectiveness of the abrasive motion. More simply stated, it is difficult to wear away one surface by pushing another surface directly into the first surface with a force that is normal to it. To effectively wear away that first surface, the second surface must move in a direction that has a component which is generally parallel to the surface to be eroded. If that first surface is tilted in such a way that the motion of the second, or abrading surface, is essentially perpendicular to the first surface, forces exerted by the abrading surface against the first surface will be significantly less effective in causing wear to occur on the first surface. This, in a very basic and simple way, explains the concept employed in the preferred embodiments of the present invention.

By "tilting" the first surface on the underside of the jam nut 54, it is placed in a position that causes the cyclic forces exerted by the rocker aim to be exerted in a direction which is generally normal to the first surface. In order to achieve this perpendicularity, the resultant force FR is calculated and its angular relationship to the ball stud is determined. By then calculating an included angle of the first surface which makes it generally perpendicular to the resultant force, the cyclic forces can be made to be generally normal to the generally conical first surface 101. Therefore, even though the cyclic forces are not significantly changed, their effectiveness is reduced without the need to employ steel heads or inserts in aluminum heads or complicated and expensive hydraulic lash adjustors. Even though certain alternative embodiments of the present invention accommodate suboptimal designs which do not precisely include mathematically exact geometry, the concepts of preferred embodiments of the present invention serve to guide a valve train designer toward effective contact surfaces which significantly reduce the abrasion that can lead to inefficient and potentially disastrous operation of an internal combustion engine. It should also be understood that the primary advantages of preferred embodiments of the present invention are a result of an accurate identification of the mechanisms that wear away portions of the contact surfaces of the jam nut and head of the engine to loosen the attachment. Preferred embodiments of the present invention address this mechanism of wear and accommodate the cyclic motion of vibration in a way that reduces wear. It accomplishes this by determining an included angle of the conical first surface as a function of the angle between a central axis of the ball stud and the resultant force exerted on the ball stud by the rocker arm. This included angle can be generally equal to twice the magnitude of the angle of the resultant force and central axis of the ball stud or, alternatively, a value which is generally equal to half of its maximum in order to select a magnitude which is suitable for many other force values experienced by the ball stud during the complete rotation of the cam about its axis.

Although the present invention has been described with considerable specificity and illustrated to show certain embodiments, it should be understood that alternative embodiments are also within its scope.

We claim:

1. An actuating apparatus, comprising:

a rocker arm disposed in contact with a valve at a first location;

a cam disposed in contact with said rocker arm at a second location;

a pivot disposed in contact with said rocker arm at a third location;

a stud attached to said pivot and configured to support said pivot relative to a structure; and a jam nut movably attached to said stud and configured to retain said pivot at a preselected distance from said structure, said jam nut comprising a first surface which is movable into contact with a second surface of said structure, said first surface being generally conical, wherein said first surface has an included angle which is selected as a function of the angle between a central axis of said stud and a force exerted by said rocker arm on said stud when said cam is at a preselected rotational angle about its axis, said included angle being generally equal to twice the magnitude of said angle between said central axis of said stud and said force exerted by said rocker arm on said stud when said cam is at said preselected rotational angle about its axis.

2. The apparatus of claim 1 wherein:

said force is a resultant force having a radial component which is perpendicular to said central axis of said stud and an axial component which is parallel to said central axis.

3. The apparatus of claim 2 wherein:

said preselected rotational angle of said cam is selected to result in said radial component being generally equal to half of its maximum magnitude of all rotational angles of said cam.

4. The apparatus of claim 1, wherein:

said pivot is defined by a convex hemispherical surface disposed at an end of said stud and a concave hemispherical surface formed in said rocker arm.

5. The apparatus of claim 1, wherein:

said structure is a head of an engine.

6. The apparatus of claim 1, wherein:

said stud is attached in threaded engagement within a threaded hole of said structure; and said jam nut is attached in threaded engagement with said stud, said first surface being movable into contact with said second surface in response to movement of said jam nut away from said pivot.

7. The apparatus of claim 1, wherein:

said third location comprises a series of contact points between said rocker arm and said pivot.

8. The apparatus of claim 1, wherein:

said pivot is an integral part of said stud.

9. An actuating apparatus, comprising:

a rocker arm disposed in contact with a valve at a first location;

a cam disposed in contact with said rocker arm at a second location;

a pivot disposed in contact with said rocker arm at a third location;

a stud attached to said pivot and configured to support said pivot relative to a head of an internal combustion engine, said pivot being defined by a convex hemispherical surface disposed at an end of said stud and a concave hemispherical surface formed in said rocker arm; and a jam nut movably attached to said stud and configured to retain said pivot at a preselected distance from said head, said jam nut comprising a first surface which is movable into contact with a second surface of said head, said first surface being generally conical with an included angle which is selected as a function of the angle between a central axis of said stud and a force exerted by said rocker arm on said stud when said cam is at a preselected rotational angle about its axis, said stud being attached in threaded engagement within a threaded hole of said head, said jam nut being attached in threaded engagement with said stud, said first surface being movable into contact with said second surface in response to movement of said jam nut away from said pivot.

10. The apparatus of claim 9 wherein:

said force is a resultant force having a radial component which is perpendicular to said central axis of said stud and an axial component which is parallel to said central axis.

11. The apparatus of claim 9, wherein:

said included angle is generally equal to twice the magnitude of said angle between said central axis of said stud and said force exerted by said rocker arm on said stud when said cam is at said preselected rotational angle about its axis.

12. The apparatus of claim 9 wherein:

said preselected rotational angle of said cam is selected to result in said radial component being generally equal to half of its maximum magnitude of all rotational angles of said cam.

13. The apparatus of claim 9, wherein:

said third location comprises a series of contact points between said rocker arm and said pivot.

14. The apparatus of claim 9, wherein:

said pivot is an integral part of said stud.

15. An actuating apparatus, comprising:

a rocker arm disposed in contact with a valve at a first location;

a cam disposed in contact with said rocker arm at a second location;

a pivot disposed in contact with said rocker arm at a third location;

a stud attached to said pivot and configured to support said pivot relative to a head of an engine, said pivot being defined by a convex hemispherical surface disposed at an end of said stud and a concave hemispherical surface formed in said rocker arm, said pivot being an integral part of said stud; and a jam nut movably attached to said stud and configured to retain said pivot at a preselected distance from said head, said jam nut comprising a first surface which is movable into contact with a second surface of said head, said first surface being generally conical with an included angle which is selected as a function of the angle between a central axis of said stud and a force exerted by said rocker arm on said stud when said cam is at a preselected rotational angle about its axis, said stud being attached in threaded engagement within a threaded hole of said head, said jam nut being attached in threaded engagement with said stud, said first surface being movable into contact with said second surface in response to movement of said jam nut away from said pivot.

16. The apparatus of claim 15, wherein:

said included angle is generally equal to twice the magnitude of said angle between said central axis of said stud and said force exerted by said rocker arm on said stud when said cam is at said preselected rotational angle about its axis.

17. The apparatus of claim 15 wherein:

said force is a resultant force having a radial component which is perpendicular to said central axis of said stud and an axial component which is parallel to said central axis.

18. The apparatus of claim 15 wherein:

said preselected rotational angle of said cam is selected to result in said radial component being generally equal to half of its maximum magnitude of all rotational angles of said cam.

19. The apparatus of claim 15, wherein:

said third location comprises a series of contact points between said rocker arm and said pivot.

* * * * *